US006268320B1

(12) United States Patent
Crawford

(10) Patent No.: US 6,268,320 B1
(45) Date of Patent: Jul. 31, 2001

(54) SULPHUR-CONTAINING CALIXARENES, METAL SALTS THEREOF, AND ADDITIVE AND LUBRICATING OIL COMPOSITIONS CONTAINING THEM

(75) Inventor: John Crawford, Caterham Surrey (GB)

(73) Assignee: Lubrizol Adibis Holdings (UK) Limited, Merseyside (GB)

( * ) Notice: Subject to any disclaimer, the term of this patent is extended or adjusted under 35 U.S.C. 154(b) by 0 days.

(21) Appl. No.: 09/297,760

(22) PCT Filed: Oct. 9, 1998

(86) PCT No.: PCT/GB98/03044

§ 371 Date: May 5, 1999

§ 102(e) Date: May 5, 1999

(87) PCT Pub. No.: WO99/19427

PCT Pub. Date: Apr. 22, 1999

(30) Foreign Application Priority Data

Oct. 15, 1997 (GB) ..... 9721735

(51) Int. Cl.[7] ..... C10M 135/30

(52) U.S. Cl. ..... 508/572; 508/585; 508/586; 568/75

(58) Field of Search ..... 508/572, 585, 508/586; 568/75

(56) References Cited

FOREIGN PATENT DOCUMENTS 0450874 10/1991 (EP) .
0755998 1/1997 (EP) .

OTHER PUBLICATIONS

International Search Report for PCT Application No. PCT/GB98/03044; Mailed on Feb. 4, 1999.

Nakayama et al., "Cyclic oligo (thio–2,5–thienylenes) Sulfur–bridged Calixarenes," Chemical Abstracts, Columbus, Ohio, U.S. vol. 127, No. 9, Abstract No. 293203j, p. 675, XP–002090554, Date unknown.

T. Sone et al., Tetrahedron, vol. 53, No. 31, pp. 10689–10698, 1997, "Synthesis and Properties of Sulfur–Bridged Analogs of p–tert–Butylcalix[4]Arene".

Juzo Nakayama et al., Chemistry Letters 1997, pp. 897–898, Cyclic Oligo(Thio–2,5–Thienylenes)(Sulfur–Bridged Calixarenes).

*Primary Examiner*—Margaret Medley
*Assistant Examiner*—Cephia D. Toomer
(74) *Attorney, Agent, or Firm*—Michael F. Esposito, Esq.

(57) ABSTRACT

This invention relates to a composition comprising at least one sulphur-containing calixarene represented by formula (I)

(I)

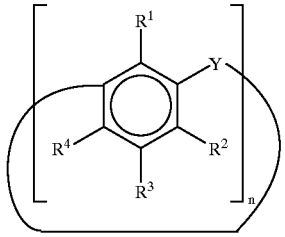

or a metal salt of said calixarene, wherein in formula (I): Y is a divalent bridging group, at least one of said bridging groups being a sulphur atom; $R^3$ is hydrogen, a hydrocarbyl or a hetero-substituted hydrocarbyl group; either $R^1$ is hydroxyl and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl; and n is a number having a value of at least 4. In one embodiment, the foregoing salt is an overbased salt. The invention also relates to additive compositions and finished lubricating oil compositions containing the foregoing overbased salt. The invention also relates to a process for making the foregoing overbased salt.

52 Claims, No Drawings

SULPHUR-CONTAINING CALIXARENES, METAL SALTS THEREOF, AND ADDITIVE AND LUBRICATING OIL COMPOSITIONS CONTAINING THEM

This application is a 371 of PCT/GB98/03044 filed Oct. 9, 1998.

TECHNICAL FIELD

This invention relates to sulphur-containing calixarenes, and to metal salts of such calixarenes, especially overbased metal salts. The invention also relates to the preparation of such overbased salts as well as their use in additive compositions and finished lubricating oil compositions.

BACKGROUND OF THE INVENTION

In the operation of internal combustion engines, by-products from the combustion chamber often blow by the piston and admix with the lubricating oil. Compounds generally employed to neutralize the acidic materials and disperse sludge within the lubricating oil are overbased, alkaline earth metal, sulphurised, hydrocarbyl-substituted phenates, salicylates, napthenates and sulphonates. The term "overbased" is generally used to describe metal salts in which the ratio of the number of equivalents of the metal moiety to the number of equivalents of the acid moiety is greater than 1:1, and is usually greater than 1.2:1 and may be as high as 4.5:1 or greater. In contrast, the equivalent ratio of a metal moiety to acid moiety in "normal" or "neutral" metal salts is 1:1, and in "low-based" salts it is less than 1:1. Thus, the overbased material usually contains greater than 20% in excess of the metal present in the corresponding neutral material. For this reason overbased metal salts have a greater capability for neutralising acidic matter than do the corresponding neutral salts, though not necessarily an increased detergency power.

For environmental reasons it has become desirable to minimise the amount of sulphur in such materials, due to the resulting sulphur dioxide emissions associated with lubricant combustion in service, as well as in additive production. In response to the perceived desirability of providing sulphur-free overbased metal salts suitable for use as detergent additives in lubricating oils EP 0 450 874 discloses a non-sulphurised overbased metal salt of a sulphur-free calixarene having a substituent hydroxyl group or groups available for reaction with a metal base and their preparation by reacting at elevated temperature:

(A) either (i) a sulphur-free calixarene having a substituent hydroxyl group or groups available for reaction with metal base, (ii) a low-based metal calixarate, (iii) a neutral metal calixarate or (iv) an overbased metal calixarate, (B) a metal base added either in a single addition or in a plurality of additions at intermediate points during the reaction, (C) a solvent comprising either: ($C_1$) either (i) a polyhydric alcohol having 2 to 4 carbon atoms, (ii) a di-($C_3$ or $C_4$) glycol, (iii) a tri-($C_2$–$C_4$) glycol or (iv) a mono-or poly-alkylene glycol alkyl ether of the formula:

$$R^9(OR^{10})_f O\ R^{11} \qquad \text{(II)}$$

wherein in the formula (II) $R^9$ is a $C_1$ to $C_6$ alkyl group, $R^{10}$ is an alkylene group, e.g. of 1–6 or 2–4 carbon atoms, $R^{11}$ is hydrogen or a $C_1$ to $C_6$ alkyl group and f is an integer from 1 to 6; either alone or in combination with either: ($C_2$) a hydrocarbon solvent; or ($C_3$) either (i) water, (ii) $C_1$ to $C_{20}$ monohydric alcohol, (iii) a $C_1$ to $C_2$ ketone, (iv) a $C_1$ to $C_{10}$ carboxylic acid ester or (v) an aliphatic, alicyclic or aromatic $C_1$ to $C_{20}$ ether; or ($C_4$) a $C_1$ to $C_4$ monohydric alcohol, in combination with a hydrocarbon solvent;

(D) carbon dioxide added subsequent to each addition of component (B).

EP 0 755 988 discloses the use of sulphur-free calixarenes having a molecular weight of at least 1880 for achieving high AV (Alkalinity Values as measured by the method of ASTM D2896), typically of at least 370, for example about 450, and potentially as high as 500 or more.

While reasons exist for making sulphur-free products as described above, it is not necessary in all situations to have detergents which are entirely free of sulphur. With the present invention it has been discovered that AVs in excess of 400 can in fact be achieved at molecular weights below 1880 when the calixarene contains sulphur.

SUMMARY OF THE INVENTION

This invention relates to a composition comprising at least one sulphur-containing calixarene represented by formula (I)

(I)

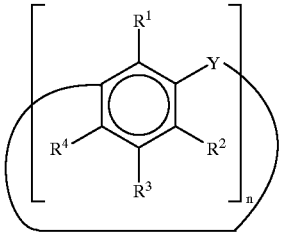

or a metal salt of said calixarene, wherein in formula (I): Y is a divalent bridging group, at least one of said bridging groups being a sulphur atom; $R^3$ is hydrogen, a hydrocarbyl or a hetero-substituted hydrocarbyl group; either $R^1$ is hydroxyl and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl; and n is a number having a value of at least 4. In one embodiment, the foregoing salt is an overbased salt. The invention also relates to additive compositions and finished lubricating oil compositions containing the foregoing overbased salt. The invention also relates to a process for making the foregoing overbased salt.

DESCRIPTION OF THE PREFERRED EMBODIMENTS

The sulphur-containing calixarenes of the invention are represented by the formula (I)

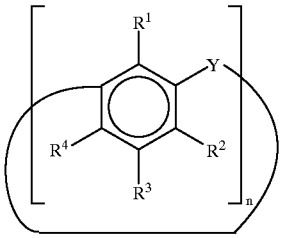

In formula (I), Y is a divalent bridging group or a sulphur atom with the proviso that at least one Y group is a sulphur atom. The divalent bridging group, when not a sulphur atom, can be a divalent hydrocarbon group or divalent hetero-substituted hydrocarbon group of 1 to 18 carbon atoms, and in one embodiment 1 to 6 carbon atoms. The hetero atoms can be —O—, —NH— or —S—. n is an integer which typically has a value of at least 4, and in one embodiment the value of n is from 4 to 12, and in one embodiment 4 to 8. In one embodiment, n-2 to n-6 of the Y groups are sulphur atoms, and in one embodiment n-3 to n-10 of the Y groups are sulphur atoms, and in one embodiment one of the Y groups is a sulphur atom. In one embodiment, the amount of sulphur incorporated in the calixarene is between 5 and 50 mole %, such that between 5 and 50% of the groups Y in formula (I) are sulphur atoms. In one embodiment, the amount of sulphur is between 8 and 20 mole %.

In one embodiment, when Y is not a sulphur atom it is a divalent group represented by the formula $(CHR^6)_d$ in which $R^6$ is either hydrogen, hydrocarbyl, or a hetero-substituted hydrocarbyl group and d is an integer which is at least one. $R^6$ can be a hydrocarbyl group or a hetero-substituted hydrocarbyl group of 1 to 18 carbon atoms, and in one embodiment 1 to 6 carbon atoms. Examples include methyl, ethyl, propyl, isopropyl, butyl, isobutyl, and the like. In one embodiment d is from 1 to 3, and in one embodiment 1 to 2, and in one embodiment d is 1. The hetero-substituted hydrocarbyl groups are those in which the heteroatom, typically —O—, —NH— or —S—, interrupts a chain of carbon atoms, an example being an alkoxy-alkyl group of 2 to 20 carbons.

$R^3$ is hydrogen, a hydrocarbyl or a hetero-substituted hydrocarbyl group. $R^3$ may be a hydrocarbyl group derived from a polyolefin, for example polyethylene, polypropylene, polybutylene or polyisobutylene, or a polyolefin copolymer, for example an ethylene/propylene copolymer. Examples of $R^3$ include dodecyl and octadecyl. The hetero atoms can be —O—, —NH— or —S—. These hydrocarbyl groups and hetero-substituted hydrocarbyl groups typically have 1 to 20 carbon atoms, and in one embodiment 1 to 6 carbon atoms.

Either $R^1$ is hydroxyl and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl. In one embodiment, $R^1$ is hydrogen, $R^2$ and $R^1$ are hydroxyl, and $R^3$ is either hydrogen, hydrocarbyl or hetero—substituted hydrocarbyl in the formula (I) and the calixarene is a resorcinarene. The hydrocarbyl groups and hetero-substituted hydrocarbyl groups typically have 1 to 24 carbon atoms, and in one embodiment 1 to 12 carbon atoms. The hetero atoms of such hereto-substituted hydrocarbyl groups can be —O—, —NH—, or —S—.

In one embodiment, Y is either sulphur or $(CR^7R^8)_e$, where either one of $R^7$ and $R^8$ is hydrogen and the other is hydrogen or hydrocarbyl; $R^2$ and $R^4$ are independently either hydrogen, hydrocarbyl or hetero-substituted hydrocarbyl, $R^3$ is either hydrocarbyl or hetero-substituted hydrocarbyl; n is 6; and e is at least 1, and in one embodiment e is in the range of 1 to 4, and in one embodiment e is 1. In one embodiment, $R^2$ and $R^4$ are hydrogen; $R^3$ is hydrocarbyl, preferably alkyl of greater than 4, more preferably greater than 9, more preferably greater than 12 carbon atoms; one of $R^7$ or $R^8$ is hydrogen and the other is either hydrogen or alkyl, preferably hydrogen.

The foregoing sulphur-containing calixarenes typically have a molecular weight below 1880. In one embodiment, the molecular weight of the sulphur-containing calixarene is from 460 to 1870, and in one embodiment from 460 to 1800, and in one embodiment 460 to 1750.

For a review of calixarenes and their preparation reference is made to 'Monographs in Supramolecular Chemistry' by C David Gutsche, Series Editor—J Fraser Stoddart, published by the Royal Society of Chemistry, 1989. Calixarenes having a substituent hydroxyl group or groups include homocalixarenes, oxacalixarenes, homooxacalixarenes and heterocalixarenes. Calixarenes may be prepared as described in the aforesaid Monograph, Chapter 2, which is incorporated herein by reference. The sulphur-containing calixarenes of the invention may be prepared by the reaction of a phenol, a hydrocarbyl substituted phenol, or a hetero-substituted hydrocarbyl sustituted phenol, which is unsubstituted at the ortho-positions, with a base, an aldehyde and sulphur. The aldehyde can be formaldehyde, which is generally in one of its polymeric forms.

In one embodiment of the invention provides a metal salt of the foregoing sulphur-containing calixarenes. The metal moiety may be any metal capable of forming a salt with a calixarene. In one embodiment, the metal moiety is an alkali or an alkaline earth metal. Preferred metals include calcium, magnesium or barium. A particularly preferred metal is calcium. Mixtures of metals may also be employed. The salts are sometimes referred to hereinafter as "calixarates". Overbased calixarates are especially preferred. Overbased calixarates are calixarates in which the ratio of the number of equivalents of the metal moiety to the number of equivalents of the sulphur-containing calixarene moiety is greater than one. In one embodiment, the ratio of molar equivalents of metal moiety to the number of equivalents of the sulphur-containing calixarene is at least 1.1:1, and in one embodiment in the range of 1.1:1 to 6:1, and in one embodiment from 1.1:1 to 3:1.

In one embodiment of the invention, a process for making overbased salts of the foregoing sulphur-containing calixerenes is provided. The process comprises the steps of:

(I) forming a mixture of components (A) and (C);

component (A) comprising either (i) a sulphur-containing calixarene having at least one substituent hydroxyl group available for reaction with a metal base or (ii) a low-based, neutral or overbased metal salt of a calixarene derived from a sulphur-containing calixarene having at least one substituent hydroxyl group available for reaction with said metal base, component (C) comprising a solvent comprising either component $(C_1)$ or $(C_2)$;

component $(C_1)$ comprising either (i) a polyhydric alcohol having 2 to 4 carbon atoms, (ii) a di-$(C_3$ or $C_4)$ glycol, (iii) a tri-$(C_2$–$C_4)$ glycol or (iv) a mono- or poly-alkylene glycol alkyl ether of the formula:

$$R^9(OR^{10})_fOR^{11} \quad \text{(II)}$$

wherein in the formula (II) $R^9$ is a $C_1$ to $C_6$ alkyl group, $R^{10}$ is an alkylene group of 1 to 6 carbon atoms, $R^{11}$ is hydrogen or a $C_1$ to $C_8$ alkyl group, and f is an integer from 1 to 6;

component ($C_2$) comprising a $C_1$ to $C_4$ monohydric alcohol in combination with a hydrocarbon solvent;

(II) adding a metal base (B) to the mixture of components (A) and (C), the addition of said metal base (B) to said mixture of (A) and (C) being in a single addition or in a plurality of additions, steps (I) and (II) being performed concurrently or sequentially; and (III) adding (D) carbon dioxide to the mixture of components (A), (B) and (C) subsequent to each addition of component (B).

Component (A) may be either (i) a sulphur-containing calixarene or (ii) a low-based, neutral or overbased calixarate derived from such sulphur-containing calixarene. The calixarenes (i) are preferably those calixarenes capable of conferring oil-solubility on the overbased salt product. Preformed sulphur-containing calixarates wherein the equivalent ratio of metal base moiety to calixarene is either 1 (neutral calixarates) or less than 1 (low-based calixarates) may be employed to produce the desired sulphur-containing overbased calixarates. Alternatively, overbased sulphur-containing calixarates (iii) based on sulphur-containing calixarenes represented by formula (I) may be employed, in which case the overbased product is a sulphur-containing calixarate having an increased degree of overbasing, i.e. a higher alkalinity value.

In addition to one of the alternatives (i) to (iii), component (A) may further include a compound of the general formula:

(III)

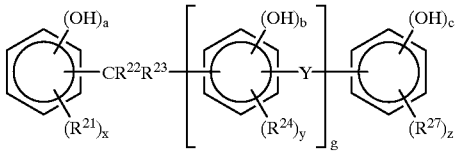

wherein in formula (III), a, b and c each independently represent 1 or 2; x, y and z each independently represent zero or an integer from 1 to 3; Y is a sulphur atom in at least one of the repeating units and the remaining Y groups are represented by the formula $CR^{25}R^{26}$; $R^{21}$, $R^{24}$ and $R^{27}$ independently represent either hydrogen or a hydrocarbyl group, when x, y or z is greater than 1, each $R^{21}$, $R^{24}$ and/or each $R^{27}$, respectively, being the same or different; $R^{22}$, $R^{23}$, $R^{25}$ and $R^{26}$ independently represent hydrogen or an alkyl group; and g is an integer from 1 to 20. The hydrocarbyl group typically contain 1 to 24 carbon atoms, and in one embodiment 1 to 12 carbon atoms.

In one embodiment, the compounds represented by formula (III) are those in which a, b and c are each 1; x, y and z are each 1; $R^{21}$, $R^{24}$ and $R^{27}$ are alkyl groups of 1 to 24 carbon atoms, and in one embodiment 1 to 12 carbon atoms; either $R^{22}$, $R^{23}$, $R^{25}$ and $R^{26}$ are each hydrogen, or $R^{22}$ and $R^{25}$ are each hydrogen and $R^{23}$ and $R^{26}$ are each methyl; and g is from 2 to 7, and in one embodiment g is 3. Where $R^{22}$ $R^{23}$, $R^{25}$ and $R^{26}$ each represent hydrogen, the compound of general formula (III) can be prepared by the condensation of the corresponding phenol with formaldehyde and sulphur. Where one of $R^{22}$ and $R^{23}$ and one of $R^{25}$ and $R^{26}$ is hydrogen and the other is a hydrocarbyl group, for example a lower alkyl group (e.g., an alkyl group of 1 to 7 carbon atoms), an aldehyde other than formaldehyde is used in the condensation with the phenol. Examples of such aldehydes include acetaldehyde, benzaidehyde, propionaldehyde, isobutyraldehyde, butyraldehyde, and the like. The mixture of overbased salts and any low-based, neutral or unreacted compounds resulting from the use of the mixed feed is useful as a lubricating oil additive.

Component (B) is a metal base. The metal moiety may be any metal capable of forming a salt with the sulphur-containing calixarenes of the invention. In one embodiment, the metal moiety is an alkali or alkaline earth metal, and in one embodiment an alkaline earth metal. The metal is preferably calcium, magnesium or barium, more preferably calcium. The base moiety may be an oxide or a hydroxide, preferably hydroxide. A calcium base may be added, for example, in the form of quick lime (CaO) or in the form of slaked lime ($Ca(OH)_2$) or mixtures of the two in any proportion. Component (B) may be added in whole to the initial reactants or in part to the initial reactants and the remainder in one or more further additions at intermediate points during the reaction.

Component (C) is a solvent for the reactants. The solvent (C) may be either ($C_1$) optionally in combination with either (a) or (b), or ($C_2$). Component ($C_1$) is either (i) a polyhydric alcohol having 2 to 4 carbon atoms, (ii) a di-($C_3$ or $C_4$) glycol, (iii) a tri-($C_2$ to $C_4$) glycol or (iv) a mono- or poly-alkylene glycol alkyl ether of the formula:

$$R^9(OR^{10})_fOR^{11} \quad \text{(II)}$$

wherein in formula (II), $R^9$ is a $C_1$ to $C_6$ alkyl group, $R^{10}$ is an alkylene group, $R^{11}$ is hydrogen or a $C_1$ to $C_6$ alkyl group, and f is an integer from 1 to 6. Examples of compounds represented by formula (III) include the monomethyl or dimethyl ethers of (a) ethylene glycol, (b) diethylene glycol, (c) triethylene glycol or (d) tetraethylene glycol. A useful compound is methyl diglycol ($CH_3OCH_2CH_2OCH_2CH_2OH$). Mixtures of glycol ethers and glycols may also be employed. The polyhydric alcohol may be either a dihydric alcohol, for example ethylene glycol or propylene glycol, or a trihydric alcohol, for example glycerol. The di-($C_3$ or $C_4$) glycol may be dipropylene glycol, the tri-($C_2$ to $C_4$) glycol may be triethylene glycol. In one embodiment, component ($C_1$) is either ethylene glycol or methyl diglycol.

Component (a) is a hydrocarbon solvent which may be aliphatic or aromatic. Examples of suitable hydrocarbons include toluene, xylene, naphtha and aliphatic paraffins, for example hexane, and cycloaliphatic paraffins.

Component (b) may be either (i) water, (ii) a $C_1$ to $C_{20}$ monohydric alcohol, (iii) a ketone having up to 20 carbon atoms, (iv) a carboxylic acid ester having up to 10 carbon atoms or (v) an aliphatic, alicyclic or aromatic ether having up to 20 carbon atoms. Examples include methanol, 2-ethyl hexanol, cyclohexanol, cyclohexanone, benzyl alcohol, ethyl acetate and acetophenone.

Component ($C_2$) may be a $C_1$ to $C_4$ monohydric alcohol, preferably methanol, in combination with a hydrocarbon solvent. The hydrocarbon solvent may be any of those referred to above as being useful of Component (a). The hydrocarbon solvent is preferably toluene.

Useful solvents (C) include ethylene glycol, a mixture of ethylene glycol and 2-ethyl hexanol, and a mixture of methanol and toluene.

Generally, in view of the intended use of the product, it is preferred to incorporate a lubricating oil as a supplemental solvent. The lubricating oil may be an animal, vegetable or mineral oil. The lubricating oil may be a petroleum—derived lubricating oil, such as a naphthenic base, paraffin base or mixed base oil. Solvent neutral oils are suitable. Alternatively, the lubricating oil may be a synthetic lubricating oil. Suitable synthetic lubricating oils include synthetic ester lubricating oils, which oils include diesters such as di-octyl adipate, di-octyl sebacate and tri-decyladipate, or polymeric hydrocarbon lubricating oils, for example liquid polyisobutenes and poly-alpha olefins.

Component (D) is carbon dioxide, added subsequent to each addition of component (B). Carbon dioxide may be added in the form of a gas or a solid, preferably in the form of a gas. In gaseous form it may be blown through the reaction mixture.

The weight ratio of component (A) to component (C) is from 1:1 to 1:12.5, and in one embodiment 1:1 to 1:5. That is, the weight ratio of (A) to (C) ranges from 1 part of (A) per 1 part of (C) to 1 part of (A) per 12.5 parts of (C), and in one embodiment from 1 part of (A) per 1 part of (C) to 1 part of (A) per 5 parts of (C). The ratio of molar equivalents of component (B) to molar equivalents of component (A) is generally from 1.1:1 to 6:1, and in one embodiment 1.1:1 to 3:1. That is, the ratio of molar equivalents of (B) to molar equivalents of (A) ranges from 1.1 equivalents of (B) per 1 equivalent of (A) to 6 equivalents of (B) per 1 equivalent of (A), and in one embodiment from 1.1 equivalents of (B) per 1 equivalent of (A) to 3 equivalents of (B) per 1 equivalent of (A). The ratio of the number of moles of metal in component (B) to the number of moles of carbon dioxide in (D) is from 1:1 to 1:3, and in one embodiment 1:1 to 1:2. That is, the molar ratio of (B) to (D) ranges from 1 mole of (B) per 1 mole of (D) to 1 mole of (B) per 3 moles of (D), and in one embodiment from 1 mole of (B) per 1 mole of (D) to 1 mole of (B) per 2 moles of (D).

In one embodiment, the reaction mixture may include component (E). Component (E) is either (i) a $C_6$ to $C_{100}$ carboxylic acid or an anhydride thereof, (ii) a di- or polycarboxylic acid containing from 36 to 100 carbon atoms or an anhydride thereof, (iii) a hydrocarbyl-substituted sulphonic acid or an anhydride thereof, (iv) a hydrocarbyl-substituted salicylic acid or an anhydride thereof, (v) a hydrocarbyl-substituted naphthenic acid or an anhydride thereof, (vi) a hydrocarbyl-substituted phenol or (vii) a mixture of any two of (i) to (vi). Of the aforesaid alternatives Component (E) is preferably (i). Component (E) may be added during step (I), (II) or (III), or prior to or subsequent to any of the foregoing steps. In one embodiment, component (E) is added during step (1). When component (E) is used, the mole ratio of component (A) to component (E) is typically from 1:1 to 1:7, and in one embodiment from 1:1.25 to 1:5.

Component (i) of component (E) may be an acid having the formula:

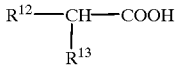

(IV)

wherein in formula (IV), $R^{12}$ is a $C_{10}$ to $C_{24}$ alkyl or alkenyl group, and $R^{13}$ is either hydrogen, a $C_1$ to $C_4$ alkyl group or a $—CH_2COOH$ group. Preferably, $R^{12}$ in formula (IV) is an unbranched alkyl or alkenyl group. Preferred acids of formula (IV) are those wherein $R^{13}$ is hydrogen and $R^{12}$ is a $C_{10}$ to $C_{24}$, more preferably $C_{18}$ to $C_{24}$ unbranched alkyl group. Examples of saturated carboxylic acids represented by formula (IV) include capric, lauric, myristic, palmitic, stearic, isostearic, arachidic, behenic and lignoceric acids. Examples of unsaturated acids formula (IV) include lauroleic, myristoleic, palmitoleic, oleic, gadoleic, erucic, ricinoleic, linoleic and linolenic acids. Mixtures of any of the foregoing acids may also be employed, for example, rape top fatty acids. Particularly suitable mixtures of acids are those commercial grades containing a range of acids, including both saturated and unsaturated acids. Such mixtures may be obtained synthetically or may be derived from natural products, for example, tall, cotton, ground nut, coconut, linseed, palm kernel, olive, palm, castor, soyabean, sunflower, herring and sardine oils and tallow.

Instead of, or in addition to, the foregoing carboxylic acids, component (E) may be an acid anhydride, acid chloride or the ester derivative of any of the foregoing acids, and of these the acid anhydride is preferred. It is preferred, however, to use a carboxylic acid or a mixture of carboxylic acids. A preferred carboxylic acid of formula (IV) is stearic acid. Component (E) may be present in an amount up to 40% by weight based on the total weight of the product made by the reaction of components (A), (B), (C), (D) and optionally (E). While not wishing to be bound by theory, it is believed that component (E) when present, chemically modifies the overbased calixarate product.

As regards component (ii) of component (E), this is preferably a polyisobutene succinic acid or a polyisobutene succinic anhydride. The molecular weight of such acid or anhydride is in the range of 300 to 3000, and in one embodiment 300 to 2500, and in one embodiment 700 to 2400, and in one embodiment 700 to 1300.

As regards (iii), (iv), (v) and (vi) of component (E), the hydrocarbyl substituent may contain up to 125 aliphatic carbon atoms, and in one embodiment 6 to 20 carbon atoms. Examples of suitable substituents include alkyl groups, for example hexyl, cyclohexyl, octyl, isoctyl, decyl, tridecyl, hexadecyl, eicosyl and tricosyl. Hydrocarbyl groups derived from the polymerisation of both terminal and internal olefins, for example ethene, propene, 1-butene, isobutene, 1-hexene, 1-octene, 2-butene, 2-pentene, 3-pentene and 4-octene can be used. In one embodiment, the hydrocarbyl substituent is derived from polypropylene, poly-1-butene or polyisobutylene, preferably polyisobutylene.

The reaction mixture may also incorporate as component (F) a catalyst (or promoter) for the reaction. The catalyst may be an organic compound or an inorganic compound. The catalyst (F) is added during step (I), (II) or (III), or prior to or subsequent to any of the foregoing steps. In one embodiment, the catalyst (F) is added during step (I). When component (F) is used, the amount of component (F), added to the mixture of (A), (B), (C), (D) and optionally (E) ranges from 0.1% to 3% by weight based on the combined weight of the mixture, and in one embodiment 2% by weight. Suitable organic compounds include (i) organic halides (e.g., chlorides, bromides, iodides) or (ii) organic alkanoates, which may be represented by the formula:

$$R^{14}—X \qquad (V)$$

wherein in the formula (V), $R^{14}$ is either an alkyl, aryl or alkaryl group preferably having 3 to 20 or 6 to 20 or 7 to 20 carbons, respectively, or a halo-derivative thereof. X is either halogen, suitably chlorine, bromine or iodine, preferably chlorine, or the group $OCOR^{15}$ wherein $R^{15}$ is $C_1$ to $C_4$ alkyl. Alternatively, the organic halide may be an HX salt of an organic base, for example guanidine hydrochloride. An example of an organic halide represented by formula (V) is octyl chloride. Mixtures of (i) and (ii) of component (F) may also be employed. Suitable inorganic compound catalysts include inorganic halides, particularly inorganic chlorides, and inorganic alkanoates. Examples of suitable inorganic compound catalysts include calcium acetate, calcium chloride, ammonium chloride, ammonium acetate, aluminum chloride and zinc chloride, of which calcium chloride and calcium acetate are preferred. Provided that the catalyst is present during the carbonation step (i.e., step (III)), it may be added at any point in the process, though it is usually convenient to add the catalyst initially during step (I).

In order to produce an overbased calixarate from component (A)(i) or (A)(ii) it is necessary only to react component (A) with components (B), (C) and (D), using the appropriate proportions of components (A) and (B) to achieve overbasing. Suitably component (B) may be added in one or more additions, preferably in a single addition.

In order to produce a high AV (Alkalinity Value) overbased calixarate there may be employed an overbased metal calixarate derived from a sulphur-containing calixarene having a substituent group or groups available for reaction, and it is preferred to employ component (E), particularly either (E)(i) or (ii), and more particularly stearic acid, while at the same time adjusting the relative amounts of components (A) and (B) to a value sufficient to produce the high AV desired. Again, component (B) may be incorporated in one or more additions, preferably in a single addition. The AV is at least 400, and in one embodiment at least 425. In one embodiment, the AV is at least 450, and in one embodiment it is at least 500.

The temperature at which the process is operated may be a temperature in the range from 15 to 200° C., and in one embodiment from 50 to 175° C. The selection of the optimum temperature within the aforesaid range is dependent in part on the nature of the solvent employed.

Generally, the process is operated in the presence of a lubricating oil. At the conclusion of the process it is preferred to recover the salt as a solution in lubricating oil by separating off volatile fractions, for example, by distillation at subatmospheric pressure. Finally, it is preferred to filter the solution. Alternatively, the solution may be centrifuged.

In one embodiment, the present invention provides for an additive composition suitable for use in lubricating oils which composition comprises a lubricating oil and an overbased metal calixarate as hereinbefore described, the lubricating oil comprising from 10 to 80% by weight based on the weight of the additive composition, and in one embodiment from 15 to 40% by weight. The additive composition may be obtained by the process of the invention, using a solvent comprising a lubricating oil. The additive composition may have an AV of at least 400, and in one embodiment at least 425, and in one embodiment at least 450, and in one embodiment at least 500.

In one embodiment of the present invention, an additive composition suitable for use in lubricating oils is provided, which composition comprises: as a first component an overbased calixarate as hereinbefore described; and as a second component a neutral and/or an overbased metal salt of at least one of:

(i) a $C_6$ to $C_{100}$ carboxylic acid, (ii) a di- or polycarboxylic acid containing from 36 to 100 carbon atoms, (iii) a hydrocarbyl-substituted suilphonic acid, (iv) a hydrocarbyl-substituted salicylic acid, (v) a hydrocarbyl-substituted naphthenic acid or (vi) a hydrocarbyl-substituted phenol.

The metal moiety of the salts in this additive composition may be either an alkali or an alkaline earth metal, preferably alkaline earth metal, more preferably calcium, magnesium or barium. The additive composition may be prepared simply by mixing the components. Preferably, however, the additive composition is prepared by reacting components (A), (B), (C) and (D), and optionally (E) and/or (F) as described above, to prepare the first component, and then adding the foregoing second component.

The overbased sulphur-containing calixarates of the invention are useful in lubricating oils both for their acid neutralisation capability and their detergent and antioxidant properties.

In one embodiment of the present invention, a finished lubricating oil composition is provided. This finished lubricating oil composition comprises a lubricating oil and an overbased metal salt of a sulphur-containing calixarene as hereinbefore described. The overbased metal salt is present in an amount of from 0.1 to less than 20 percent by weight based on the weight of the finished lubricating oil composition, and in one embodiment from 5 to 15 percent by weight. The finished lubricating oil composition may also contain effective amounts of one or more other types of conventional lubricating oil additives, for example viscosity index improvers, anti-wear agents, antioxidants, dispersants, rust inhibitors, pour-point depressants, and the like.

EXAMPLES

The invention will now be further illustrated by reference to the following Examples. In all the Examples the term AV (Alkalinity Value) is used. AV is expressed in terms of mg KOH/g as measured by ASTM D2896. In the Examples where lime is used, it is in the form of slaked lime, $Ca(OH)_2$. Viscosities were measured by the method of ASTM D445. In the Examples as well as throughout the specification and claims, unless otherwise specifically indicated, all parts and percentages are by weight, all temperatures are in the degrees Celsius, and all pressures are atmospheric.

Example 1

Preparation of Sulphur-containing Dodecylcalix[8]arene

A five liter flange flask is charged with the following ingredients: 357.3 g of dodecylphenol (1.333 moles, 1 equiv); 56 g of formaldehyde (1,867 moles, 1.4 equiv); 26.6 ml (37.7 g) of potassium hydroxide (0.265 moles, 0.2 equiv); 1793.9 g of xylene; 8.5 g of sulphur (0.265 moles, 0.2 equiv). The mixture is rapidly heated to 75° C., and then the temperature is further increased at a rate of 1° C./minute until reflux is commenced. Water (52.5 g) is collected for 95 minutes. The mixture is maintained at reflux (145° C.) for a further three hours, and then allowed to cool overnight. The resulting mixture consists of a solution with a solid residue of potassium hydroxide. The solution is separated from the solid residue by decanting off, and 100 g of lubricating oil are added to the solution. The xylene solvent is removed by a rotary evaporator and then further lubricating oil (486 g), is added to give a 46.5% solution of a sulphur-containing calixarene in lubricating oil. The sulphur content is 0.97% by weight.

Example 2

Preparation of Overbased Sulphur-containing Dodecylcalix[8]arate, 400+AV

An apparatus is set up consisting of a 1 liter wide neck round bottomed flask, flange lid, overhead stirrer with paddle and PTFE gland, stillhead connected to double surface condenser, receiver adaptor (vacuum) with receiver flask cooled by a butanol/$CO_2$ (S) bath and a mantle/Eurotherm/thermocouple heating system. The apparatus above the mantle and up to the condenser is insulated with glass wool.

The wide neck flask is charged with the 46.5% by weight solution of the sulphur-containing calixarene from Example 1 (130 g, 0.24 moles, 1.0 equivs), an SN150 lubricating oil (15 g), dodecyl phenol (13 g, 0.048 moles, 0.2 equivs), tall oil fatty acid (mainly oleic, linoleic, linolenic acid: 85 g, 0.302 mol, 1.4 equivs), ethylene glycol (9 g, 0.145 mol, 0.69 equivs), 2-ethyl hexanol (solvent) (150 g), calcium hydroxide (108 g, 1.42 moles, 5.82 equivs.). The mixture is heated to 90° C. at a vacuum of −11 inches Hg (19 inches Hg absolute pressure). The vacuum is temporarily raised to −28 inches Hg (2 inches Hg absolute pressure) before being returned to −11 inches Hg (19 inches Hg absolute pressure) and the temperature is raised to 130° C. Further ethylene glycol (45 g, 0.726 moles, 3.42 equivs) is then added dropwise, and the mixture is heated at 130° C. and −11 inches Hg (19 inches Hg absolute pressure) for a further 20 minutes. The mixture is carbonated using a dip tube connected to a Buchner flask containing solid carbon dioxide (37 g, 0.84 moles, 3.97 equivs) at 130° C. and vacuum of −3 inches Hg (27 inches Hg absolute pressure). The mixture is then heated at 200° C. and −28 inches Hg (2 inches Hg absolute pressure) to remove all solvents. The crude product is filtered hot (temperature of 100° C.) through a ½ inch (1.2 cm) celite pad to give a brown clear liquid product. The product has the following analysis:

| | |
|---|---|
| Calcium | 15.13% by weight |
| Sulphur | 0.35% by weight |
| AV | 422.5 mg KOH/g |
| $V_{100}$ | 644 cSt |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition comprising at least one metal salt of sulphur-containing calixarene represented by formula (I)

(I)

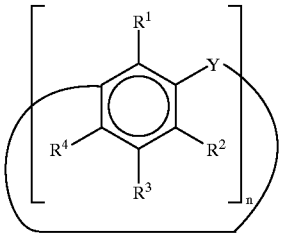

wherein in formula (I): Y is a divalent bridging group, at least one of said bridging groups being a sulphur atom; $R^3$ is hydrogen, a hydrocarbyl or a hetero-substituted hydrocarbyl group; either $R^1$ is hydroxyl and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl; and n is a number having a value of at least 4.

2. The composition of claim 1 wherein $R^1$ is hydrogen, $R^2$ and $R^4$ are hydroxyl, and $R^3$ is either hydrogen, hydrocarbyl or hetero-substituted hydrocarbyl.

3. The composition of claim 1 wherein the groups Y that are not sulphur atoms are represented by the formula $(CHR^6)_d$ in which $R^6$ is either hydrogen or hydrocarbyl and d is an integer that is at least 1.

4. The composition of claim 1 wherein 5% to 50% of the groups Y are sulphur atoms, the remainder being $(CHR^6)_d$ wherein $R^6$ is either hydrogen or hydrocarbyl and d is an integer which is at least 1.

5. The composition of claim 1 wherein: the Y groups that are not sulphur atoms are represented by the formula $(CR^7R^8)_e$, where either one of $R^7$ and $R^8$ is hydrogen and the other is hydrogen or hydrocarbyl, and e is an integer that is at least 1; $R^1$ is hydroxyl; $R^2$ and $R^4$ are independently either hydrogen, hydrocarbyl or hetero-substituted hydrocarbyl; $R^3$ is either hydrocarbyl or hetero-substituted hydrocarbyl; and n is 6.

6. The composition of claim 1 wherein $R^3$ is a hydrocarbyl group derived from a polyolefin.

7. The composition of claim 1 wherein $R^3$ is a hydrocarbyl group derived from polyisobutene.

8. The composition of claim 1 wherein $R^3$ is dodecyl or octadecyl.

9. The composition of claim 1 wherein the molecular weight of said sulphur-containing calixarene is below 1880.

10. The composition of claim 1 wherein the metal moiety of said metal salt is either an alkali or an alkaline earth metal.

11. The composition of claim 1 wherein the metal moiety of said metal salt is calcium, magnesium or barium.

12. The composition of claim 1 wherein the metal moiety of said metal salt is calcium.

13. The composition of claim 1 wherein said salt is an overbased salt.

14. The composition of claim 1 wherein said composition has a metal moiety and a sulfur-containing calixarene moiety and the ratio of the number of equivalents of the metal moiety to the number of equivalents of the sulfur-containing calixarene moiety is at least 1.1:1.

15. The composition of claim 1 wherein said composition has a metal moiety and a sulfur-containing calixarene moiety and the ratio of the number of equivalents of the metal moiety to the number of equivalents of the sulfur-containing calixarene moiety is from 1.1:1 to 6:1.

16. The composition of claim 1 wherein said composition has an alkalinity value that is at least 400.

17. The composition of claim 1 wherein the composition has an alkalinity value that is at least 450.

18. The composition of claim 1 wherein said salt is an overbased salt, said sulphur-containing calixarene has a molecular weight below 1880, and said composition has an alkalinity value in excess of 400.

19. An additive composition comprising a lubricating oil and the composition of claim 1, wherein said salt is an overbased salt.

20. The additive composition of claim 19 wherein the molecular weight of said sulphur-containing calixarene is below 1880, said salt is in the form of an overbased salt, and said additive composition has an alkalinity value in excess of 400.

21. An additive composition comprising the composition of claim 1, wherein said salt is an overbased salt, and a neutral or overbased metal salt of at least one of (i) a $C_6$ to $C_{100}$ carboxylic acid, (ii) a di- or polycarboxylic acid containing from 36 to 100 carbon atoms, (iii) a hydrocarbyl-substituted sulphonic acid, (iv) a hydrocarbyl-substituted salicylic acid, (v) a hydrocarbyl-substituted naphthenic acid, or (vi) a hydrocarbyl-substituted phenol.

22. A finished lubricating oil composition, comprising the composition of claim 1, wherein said salt is an overbased salt, and a lubricating oil, said overbased salt being present in said finished lubricating oil composition in an amount of from 0.1 to less than 20 percent by weight based on the weight of the finished lubricating oil composition.

23. The finished lubricating oil composition of claim 22 wherein said lubricating oil composition further comprises at least one viscosity index improver, anti-wear agent, antioxidant, dispersant, rust inhibitor or pour-point depressant.

24. A process for making an overbased salt, comprising the following steps:

(I) forming a mixture of components (A) and (C);

component (A) comprising either (i) a sulphur-containing calixarene having at least one substituent hydroxyl group available for reaction with a metal base or (ii) a low-based, neutral or overbased metal salt of a calixarene derived from a sulphur-containing calixarene having at least one substituent hydroxyl group available for reaction with said metal base, component (C) comprising a solvent comprising either component ($C_1$) or ($C_2$);

component ($C_1$) comprising either (i) a polyhydric alcohol having 2 to 4 carbon atoms, (ii) a di-($C_3$ or $C_4$) glycol, (iii) a tri-($C_2$–$C_4$) glycol or (iv) a mono- or poly-alkylene glycol alkyl ether of the formula:

$$R^9(OR^{10})_fOR^{11} \quad \text{(II)}$$

wherein in the formula (II) $R^9$ is a $C_1$ to $C_6$ alkyl group, $R^{10}$ is an alkylene group of 1 to 6 carbon atoms, $R^{11}$ is hydrogen or a $C_1$ to $C_8$ alkyl group, and f is an integer from 1 to 6;

component ($C_2$) comprising a $C_1$ to $C_4$ monohydric alcohol in combination with a hydrocarbon solvent;

(II) adding a metal base (B) to the mixture of components (A) and (C), the addition of said metal base (B) to said mixture of (A) and (C) being in a single addition or in a plurality of additions, steps (I) and (II) being performed concurrently or sequentially; and (III) adding (D) carbon dioxide to the mixture of components (A), (B) and (C) subsequent to each addition of component (B).

25. The process of claim 24 wherein component ($C_1$) further comprises: (a) a hydrocarbon solvent; or (b) either (i) water, (ii) a $C_1$ to $C_{20}$ monohydric alcohol, (iii) a ketone having up to 20 carbon atoms, (iv) a carboxylic ester having up to 10 carbon atoms, or (v) an aliphatic, alicyclic or aromatic ether having up to 20 carbon atoms.

26. The process of claim 24 wherein component (A) further comprises a compound of the formula:

(III)

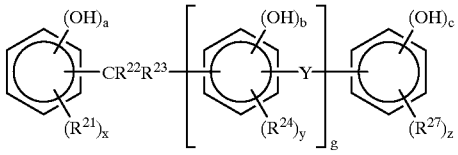

wherein in formula (III): a, b and c each independently represent 1 or 2; x, y and z each independently represent zero or an integer of from 1 to 3; at least one of Y is a sulphur atom and the remaining Y groups are represented by the formula $CR^{25}R^{26}$; $R^{21}$, $R^{24}$ and $R^{27}$ independently represent either hydrogen or a hydrocarbyl group; when x, y or z is greater than 1, each $R^{21}$, $R^{24}$ and $R^{27}$ is the same or different; $R^{22}$, $R^{23}$, $R^{25}$ and $R^{26}$ independently represent hydrogen or an alkyl group; and g is an integer of from 1 to 20.

27. The process of claim 26 wherein in formula (III) a, b and c are each 1; x, y and z are each 1; $R^{21}$, $R^{24}$ and $R^{27}$ independently represent alkyl groups or 1 to 24 carbon atoms; either $R^{22}$, $R^{23}$, $R^{25}$, and $R^{26}$ are each hydrogen, or $R^{22}$ and $R^{25}$ are each hydrogen and $R^{23}$ and $R^{26}$ are each methyl; and g is from 2to 7.

28. The process of claim 24 wherein component (C) comprises ethylene glycol, a mixture of ethylene glycol and 2-ethyl hexanol, or a mixture of methanol and toluene.

29. The process of claim 28 wherein component (C) further comprises a lubricating oil.

30. The process of claim 24 wherein during step (I), (II) or (III), or prior to or subsequent to any of the foregoing steps, component (E) is added, component (E) comprising: (i) a $C_6$ to $C_{100}$ carboxylic acid or anhydride thereof; (ii) a di- or polycarboxylic acid or anhydride thereof containing from 36 to 100 carbon atoms; (iii) a hydrocarbyl-substituted sulphonic acid or anhydride thereof; (iv) a hydrocarbyl-substituted salicylic acid or anhydride thereof; (v) a hydrocarbyl-substituted naphthenic acid or anhydride thereof; (vi) a hydrocarbyl-substituted phenol; or (vii) a mixture of two or more of (i) to (vi).

31. The process of claim 24 wherein during step (I), (II) or (III), or prior to or subsequent to any of the foregoing steps, component (F) is added, component (F) being a catalyst.

32. The process of claim 24 wherein said process is conducted at a temperature in the range of 15° C. to 200° C.

33. The process of claim 24 wherein the weight ratio of (A) to (C) ranges from 1:1 to 1:12.5.

34. The process of claim 24 wherein the molar equivalent ratio of component (B) to component (A) is from 1.1:1 to 6:1.

35. The process of claim 24 wherein the ratio of the number of moles of metal in (B) to the number of moles of carbon dioxide in (D) is from 1:1 to 1:3.

36. A composition comprising at least one sulphur containing calixarene represented by formula (I)

(I)

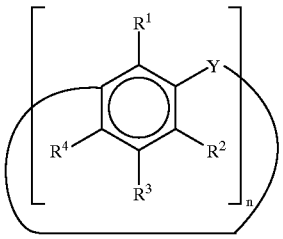

or a metal salt of said calixarene, wherein in formula (I): Y is a divalent bridging group, at least one of said bridging groups being a sulphur atom; $R^3$ is hydrogen, a hydrocarbyl or a hetero-substituted hydrocarbyl group; $R^2$ and $R^4$ are hydroxyl and $R^1$ is hydrogen; and n is a number having a value of at least 4.

37. A composition comprising at least one sulphur containing calixarene represented by the formula (I)

(I)

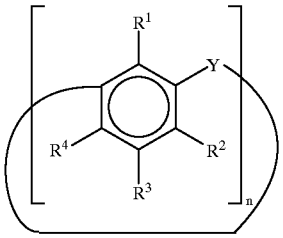

or a metal salt of said calixarene, wherein in formula (I): Y is a divalent bridging group, at least one of said bridging groups being a sulphur atom; $R^3$ is either a hydrocarbyl or a hetero-substituted hydrocarbyl group; $R^1$ is hydroxyl and $R^2$ and $R^4$ are independently either hydrogen, hydrocarbyl or hetero-substituted hydrocarbyl; and n is 6; and wherein the Y groups that are not sulphur atoms are represented by the formula $(CR^7R^8)_e$, where either one of $R^7$ and $R^8$ is hydrogen and the other is hydrogen or hydrocarbyl, and e is an integer that is at least 1.

38. A composition comprising at least one sulphur-containing calixarene represented by formula (I)

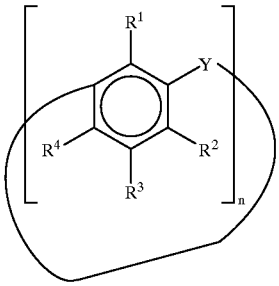

wherein in formula (I): Y is a divalent bridging group, at least one of said bridging groups being a sulphur atom; $R^3$ is hydrogen, a hydrocarbyl selected from dodecyl, octadecyl and hydrocarbyl groups derived from a polyolefin, or a hetero-substituted hydrocarbyl group; $R^1$ is hydrogen and $R^2$ and $R^4$ are hydroxyl; and n is a number having a value of at least 4.

39. A composition comprising at least one sulphur-containing calixarene represented by formula (I)

(I)

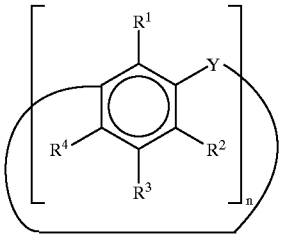

wherein in formula (I): Y is a divalent bridging group, at least one of said bridging groups being a sulphur atom, the Y groups that are not sulphur atoms being represented by the formula $(CR^7R^8)_e$, where either one of $R^7$ and $R^8$ is hydrogen and the other is hydrogen or hydrocarbyl, and e is an integer that is at least 1, $R^1$ is hydroxyl; $R^2$ and $R^4$ are independently either hydrogen, hydrocarbyl or hetero-substituted hydrocarbyl; $R^3$ is hydrogen, a hydrocarbyl selected from dodecyl, octadecyl and hydrocarbyl groups derived from a polyolefin, or a hetero-substituted hydrocarbyl group; and n is 6.

40. A composition comprising at least one sulphur-containing calixarene represented by formula (I)

(I)

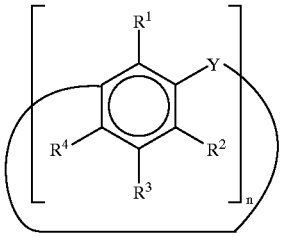

wherein in formula (I): Y is a divalent bridging group, at least one of said bridging groups being a sulphur atom; $R^3$ is a hydrocarbyl derived from polyisobutene; either $R^1$ is hydroxyl and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl; and n is a number having a value of at least 4.

41. The composition of claim 38 wherein the Y groups that are not sulphur atoms are represented by the formula $(CHR^6)_d$ in which $R^6$ is either hydrogen or hydrocarbyl and d is an integer that is at least 1.

42. The composition of claim 38 wherein 5% to 50% of the Y groups are sulphur atoms, the remainder being $(CHR^6)_d$ wherein $R^6$ is either hydrogen or hydrocarbyl and d is an integer which is at least 1.

43. The composition of claim 38 wherein $R^3$ is a hydrocarbyl group derived from a polyolefin.

44. The composition of claim 38 wherein $R^3$ is docecyl or octadecyl.

45. The composition of claim 38 wherein the molecular weight of said sulphur-containing calixarene is below 1880.

46. The composition of claim 39 wherein $R^3$ is a hydrocarbyl group derived from a polyolefin.

47. The composition of claim 39 wherein $R^3$ is a hydrocarbyl group derived from polyisobutene.

48. The composition of claim 39 wherein $R^3$ is docecyl or octadecyl.

49. The composition of claim 39 wherein the molecular weight of said sulphur-containing calixarene is below 1880.

50. The composition of claim 40 wherein the Y groups that are not sulphur atoms are represented by the formula $(CHR^6)_d$ in which $R^6$ is either hydrogen or hydrocarbyl and d is an integer that is at least 1.

51. The composition of claim 40 wherein 5% to 50% of the Y groups are sulphur atoms, the remainder being $(CHR^6)_d$ wherein $R^6$ is either hydrogen or hydrocarbyl and d is an integer which is at least 1.

52. The composition of claim 40 wherein the molecular weight of said sulphur-containing calixarene is below 1880.

* * * * *